US007284883B2

(12) United States Patent
Clark et al.

(10) Patent No.: US 7,284,883 B2
(45) Date of Patent: Oct. 23, 2007

(54) FREE-CAVITY, DOUBLE-DIFFUSING INDIRECT LIGHTING LUMINAIRE

(75) Inventors: Walter Blue Clark, Palo Alto, CA (US); David Daoud Aziz, Newark, CA (US)

(73) Assignee: Finelite, Union City, CA (US)

( * ) Notice: Subject to any disclaimer, the term of this patent is extended or adjusted under 35 U.S.C. 154(b) by 0 days.

(21) Appl. No.: 11/378,584

(22) Filed: Mar. 17, 2006

(65) Prior Publication Data

US 2006/0158879 A1 Jul. 20, 2006

Related U.S. Application Data

(63) Continuation of application No. 10/461,850, filed on Jun. 13, 2003, now Pat. No. 7,048,416.

(51) Int. Cl.
*F21S 8/06* (2006.01)

(52) U.S. Cl. ..... 362/299; 362/308; 362/328; 362/147; 362/408

(58) Field of Classification Search ..... 362/147–150, 362/299–305, 308, 309, 327–340, 403, 404, 362/408; 359/599
See application file for complete search history.

(56) References Cited

U.S. PATENT DOCUMENTS

| | | | | | |
|---|---|---|---|---|---|
| 1,472,639 | A | * | 10/1923 | Dorey | 362/331 |
| 2,545,058 | A | * | 3/1951 | Walsh | 362/224 |
| 4,186,433 | A | * | 1/1980 | Baldwin | 362/263 |
| 4,866,584 | A | | 9/1989 | Plewman | 362/225 |
| 4,974,137 | A | * | 11/1990 | Evans et al. | 362/300 |
| 5,705,804 | A | | 1/1998 | Ramer et al. | 250/206.1 |
| 5,733,028 | A | | 3/1998 | Ramer et al. | 362/32 |
| 5,773,819 | A | | 6/1998 | Ramer et al. | 250/228 |
| D405,906 | S | | 2/1999 | Herst et al. | D26/76 |
| 5,877,490 | A | | 3/1999 | Ramer et al. | 250/206.1 |
| 5,877,849 | A | | 3/1999 | Ramer et al. | 356/3.01 |
| 5,884,994 | A | | 3/1999 | Herst et al. | 362/256 |
| 5,886,351 | A | | 3/1999 | Ramer et al. | 250/228 |
| 5,914,487 | A | | 6/1999 | Ramer et al. | 250/237 R |
| 5,967,652 | A | | 10/1999 | Ramer et al. | 362/552 |
| 6,007,225 | A | | 12/1999 | Ramer et al. | 362/554 |
| 6,033,093 | A | | 3/2000 | Latsis et al. | 362/304 |

OTHER PUBLICATIONS

ZX, "The Flexible Lighting System", Lighting Solutions for every Application, 1998.
Avante, Architectural Lighting, Direct/ Indirect General Lighting System, AV 2'×4',1997.

(Continued)

*Primary Examiner*—Sandra O'Shea
*Assistant Examiner*—Bao Q. Truong
(74) *Attorney, Agent, or Firm*—Haverstock & Owens LLP

(57) ABSTRACT

A lighting system and device for providing indirect light using free-cavity, double-diffusing configurations are disclosed. In accordance with the embodiments of the invention, a lighting fixture comprises a cover structure with a diffusion layer and a reflective plate that form the free-cavity. The free-cavity is preferably configured to provide an output of light from a light source positioned within the free-cavity with an efficiency rating of 70% or more and provide better than an 8:1 ceiling lighting contrast between the rows of fixtures with rows on 16 feet spacing. Further, in accordance with a preferred embodiment of the invention, a device is configured to couple to a ceiling structure and provide the indirect lighting from a fluorescent light source.

28 Claims, 9 Drawing Sheets

OTHER PUBLICATIONS

FineLite, Better Lighting for a Better Workplace, Series 14, 1998.
Alera Lighting, "Uniquely Styled Indirect Lighting with Unsurpassed Optics", 1999.
Lighting Sciences Inc., Certified Test Report No. 17472, Jan. 16, 2003.
Lighting Sciences Inc., Certified Test Report No. 17651, Feb. 25, 2003.
ITL Boulder Test Report, May 12, 2002.
FineLite, "School Lighting", Oct. 13, 1999.

* cited by examiner

FREE-CAVITY, DOUBLE-DIFFUSING INDIRECT LIGHTING LUMINAIRE

RELATED APPLICATIONS

This Application is a Continuation Application of the application Ser. No. 10/461,850, entitled "FREE-CAVITY, DOUBLE-DIFFUSING INDIRECT LIGHTING LUMINAIRE", filed Jun. 13, 2003, now U.S. Pat. No. 7,048,416. The application Ser. No. 10/461,850, entitled "FREE-CAVITY, DOUBLE-DIFFUSING INDIRECT LIGHTING LUMINAIRE", filed Jun. 13, 2003 is hereby incorporated by reference.

FIELD OF THE INVENTION

This invention relates to the field of indirect lighting luminaires. More particularly, this invention relates to a free-cavity, double-diffusing indirect lighting luminaire apparatus, device, and system.

BACKGROUND OF THE INVENTION

Direct lighting is lighting provided from a source without reflection from other surfaces. In electrical lighting, direct lighting usually describes an installation of ceiling mounted or suspended luminaires with mostly downward light distribution characteristics. Direct lighting creates glare and harsh shadows. Parabolic fixtures create shafts of intense light. These shafts result in uneven illumination, harsh glare, and hard shadows. Deep wall shadows can cause eye strain and affect well-being and productivity.

Expensive "VDT-type" (visual display terminal) parabolic fixtures further restrict the lateral distribution of light, keeping glare off of some VDT's while increasing shadows, undue contrast and direct glare. Further, direct lighting causes veiling reflection and hard shadows.

Lensed troffers and wraps are often used for budget purposes, but result in too much glare for many uses. For example, these lighting types do not meet ANSI recommendations for today's classrooms. Light between 55° and 90° from lensed troffers and wrap-style type lighting goes directly onto computer screens and causes reflective glare.

Most indirect lighting devices require at least a 15" spacing between the ceiling and the top of the fixture. Due to the need for this 15" spacing, the aesthetics of the lighting fixture, in low-ceiling applications, are objectionable to architects. In addition there is concern that the low-hanging indirect devices will be vandalized in schools. Further, building codes require that the bottom of the fixtures be at least 6'-8" AFF. Due to these restrictions and limitations, indirect fixtures are not generally used in spaces with the typical 8'-0" to 8'-6" ceiling heights.

SUMMARY OF THE INVENTION

An indirect lighting fixture provides lighting by reflection usually from wall or ceiling surfaces. In the current invention, indirect lighting is provided through electrical lighting, with the luminaires being suspended from the ceiling or wall-mounted. The luminaires of the current invention distribute light mainly upwards and at an angle such that it is evenly reflected off the ceiling or the walls efficiently with a 3" to 6" suspension.

The current invention considers both the aesthetic and the quantitative aspects required to generate even ceiling and workplace lighting at a 0" to 6" suspension (4.5" to 10.25" overall suspension). The qualitative aspect ensures that the space has a pleasing ambiance while the quantitative aspect ensures that adequate light is provided for the task at hand with appropriate ceiling uniformities. The Illuminating Engineering Society (IES) of North America publishes guidelines for light levels for many tasks and activities based on the nature of the task, the size of objects handled, the detail required, the average age of the people in that space and so on. A typical office is lit to an illumination of 20 to 70 "foot-candles." In addition, when using indirect fixtures, the IES recommends a maximum of 8:1 contrast between the brightest and darkest parts of the ceiling between the rows of fixtures. The indirect lighting provided by the current invention meets both the aesthetic and quantitative requirements of an effective and efficient lighting system.

A major advantage of the indirect lighting provided by the current invention is that it reduces glare and harsh shadows at 0" to 6" suspension lengths. Most indirect lighting fixtures require 12" to 18" suspension lengths to accomplish the same ceiling uniformity. Thus, the current invention can provide a comfortable, evenly illuminated visual environment that is free of glare and hard shadows in spaces with 8'-0" to 9'-0" ceilings. The current invention can also be used in higher ceiling areas where the shortened suspension length helps the architect and interior designers accomplish design objectives with the fixtures closer to the ceiling. This indirect light reflects evenly off the ceiling, reducing veiling reflections and eliminating hard shadows. The indirect lighting of the current invention provides a soft, undisturbing environment suitable for concentrated work or viewing of objects and people. Further, the current invention provides flexibility because the indirect lighting emitted does not favor any specific orientation for presentations or uses in the room, nor requires specific furniture placement to meet illuminance requirements. This flexibility is due to the uniform illuminance provided by indirect lighting of the current invention. In addition, the current invention can be installed without disturbing the ceiling surface (e.g. in historical buildings or a painted ceiling).

The current invention provides more effective and efficient indirect lighting with increased energy efficiency, especially in low ceiling areas. Specifically, the current invention discloses a device for free-cavity, double-diffusing indirect lighting comprising a reflective plate, and a cover preferably comprising a plurality of diffusing layers. The free-cavity, double-diffusing indirect lighting disclosed achieves a series of objectives: lighting uniformity for 0"-6" suspension lengths from ceilings; efficient distribution of lighting (70% or greater) as a system; uniform distribution of light across the visible element of the fixture; glare protection for low viewing angles; ease of fabrication, shipping, installation, repair, and re-lamping; and various mounting configurations to meet a broad range of applications including, but not limited to, ceiling suspended, flush/surface mounted, wall mounted, or specialty white-board mounted applications.

In the current invention, the reflective plate and the cover define a free-cavity configured to output light at an efficiency of at least 70%, or alternatively, provide better than 8:1 ceiling lighting contrast between the rows of fixtures with rows on 16 feet spacing. Further, the current invention comprises a means for providing indirect lighting from a light source in the free-cavity. The means for providing indirect lighting is positioned between the reflective plate and the cover.

In other embodiments of the current invention, the device for indirect lighting disclosed is in an elongated configuration. The elongated device comprises a mounting structure and a reflective plate coupled to the mounting structure. In addition, the device comprises a cover comprising a diffusion layer and a channel feature. The elongated device reflective plate and cover define a free-cavity configured to output light at an efficiency of at least 70%. Also, the device comprises a cover attachment, wherein the cover attachment couples the reflective plate with the cover, and a flourescent light source in the free-cavity, wherein the flourescent light source is positioned between the reflective plate and the cover.

Thus, the current invention provides more effective and efficient indirect lighting. Further, the current invention has the added benefits of lower fabrication, assembly, and shipping costs, providing increased light levels, faster installation times, and reducing and making repair and maintenance easier. In sum, the current invention provides more even illumination, accommodates a variety of uses, is glare free, and provides these benefits in spaces with 8'-0" to 9'-0" ceilings where it is currently either impossible or not desirable to use prior indirect lighting fixtures.

DETAILED DESCRIPTION OF THE PREFERRED EMBODIMENT

Figure 1A:
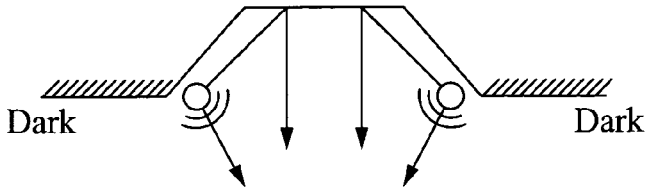
Fig. 1A (Prior Art)
FIGS. 1A-F illustrate simplified drawings of prior art lighting fixture types.
Figure 1B:
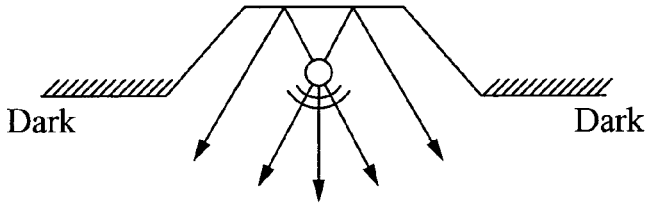
Fig. 1B (Prior Art)
Figure 1C:
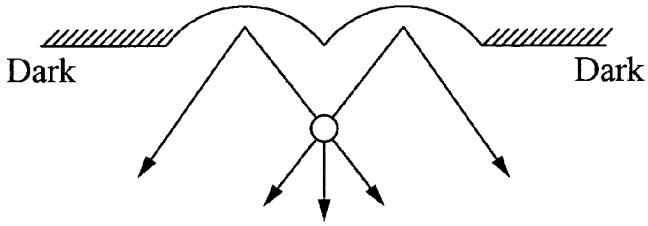
Fig. 1C (Prior Art)
Figure 1D:
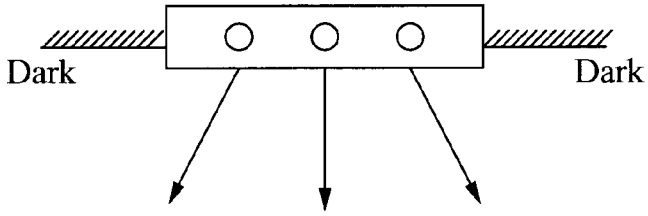
Fig. 1D (Prior Art)
Figure 1E:
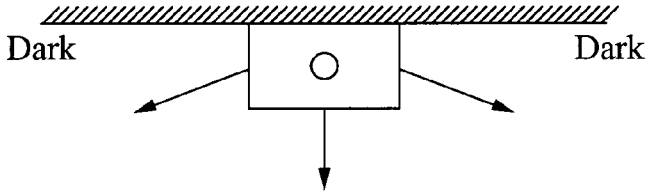
Fig. 1E (Prior Art)
Figure 1F:
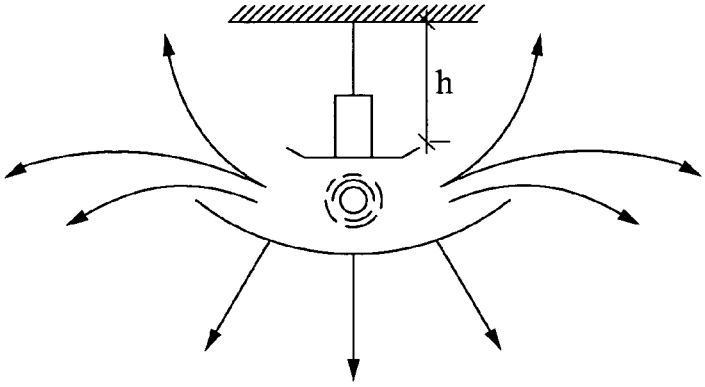
Fig. 1F (Prior Art)

FIGS. 1A-F illustrate simplified drawings of prior art lighting fixture. Specifically, FIGS. 1A-1D illustrate prior art semi-recessed direct lighting fixtures. FIG. 1E illustrates a prior art direct surface wrap type of lighting fixture, while FIG. 1F illustrates a typical indirect lighting fixture. The height "h" of the typical indirect lighting fixture shown in FIG. 1F is 12" or greater.

Figure 2A:
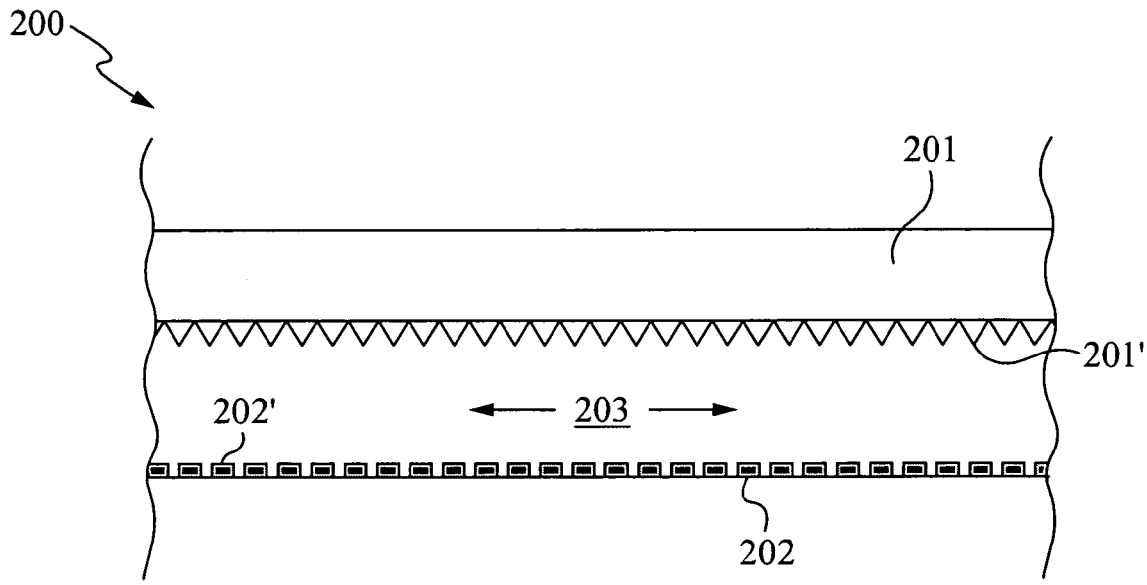
FIG. 2A illustrates a detailed cross-sectional schematic of the preferred double diffusion structure 200, in accordance with the instant invention.

FIG. 2A illustrates a detailed cross-sectional schematic of the preferred double diffusion structure 200, in accordance with the instant invention. Specifically, the double diffusion structure 200 comprises a diffusion layer 201, a plurality of micro-lenses 201', a grill 202 with a reflective surface 202'. An area between the plurality of micro-lenses 201' (of the diffusion layer 201) and the reflective surface 202' (of the grill 202) forms a diffusion cavity 203.

Figure 2B:
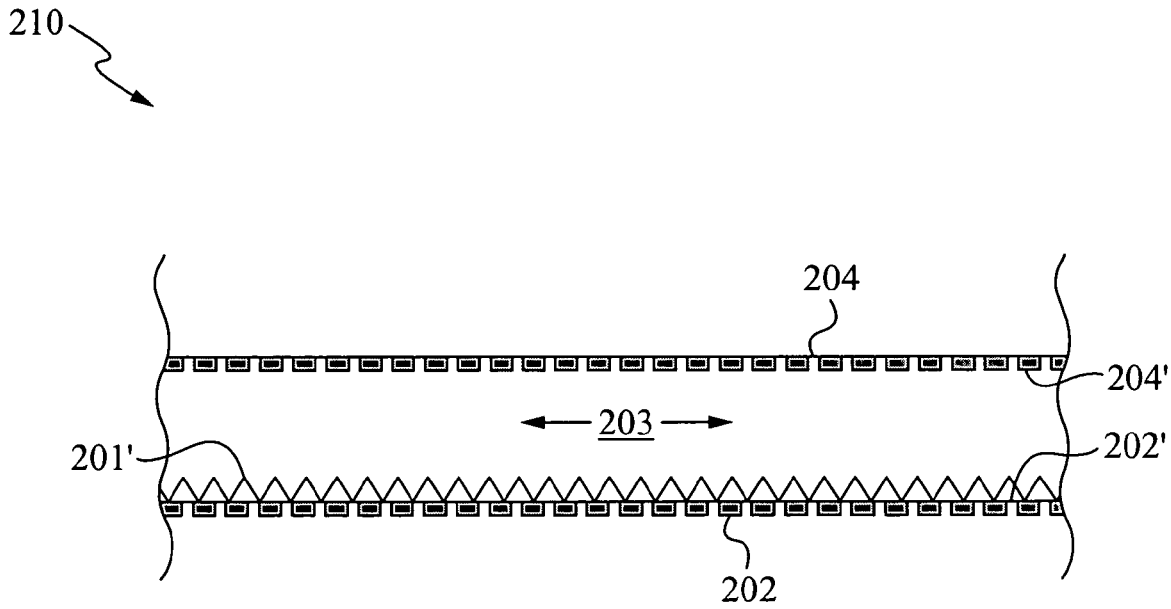
FIGS. 2B-D illustrate detailed cross-sectional schematics of alternative embodiments of the double diffusion structure shown in FIG. 2A.

FIG. 2B illustrates a detailed cross-sectional schematic of an alternative embodiment of the double diffusion structure 200 shown in FIG. 2A. Specifically, the double diffusion structure 210 shown in FIG. 2B comprises a diffusion cavity 203, a plurality of micro-lenses 201', a first grill 202 with a reflective surface 202', and a second grill 204 with a reflective surface 204'. An area between the plurality of micro-lenses 201' and the reflective surface 204' (of the second grill 204) forms the diffusion cavity 201.

Figure 2C:
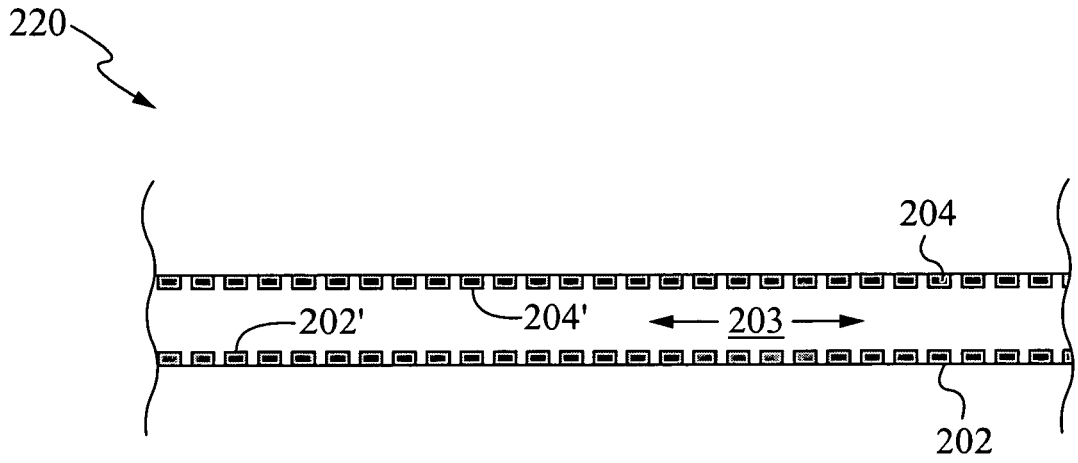

FIG. 2C illustrates a detailed cross-sectional schematic of an alternative embodiment of the double diffusion structure 200 shown in FIG. 2A. Specifically, the double diffusion structure 220 shown in FIG. 2C comprises a first grill 202 with a reflective surface 202', and a second grill 204 with a reflective surface 204'. An area between the reflective surface 202' (of the first grill 202) and the reflective surface 204' (of the second grill 202) forms a diffusion cavity 203.

Figure 2D:
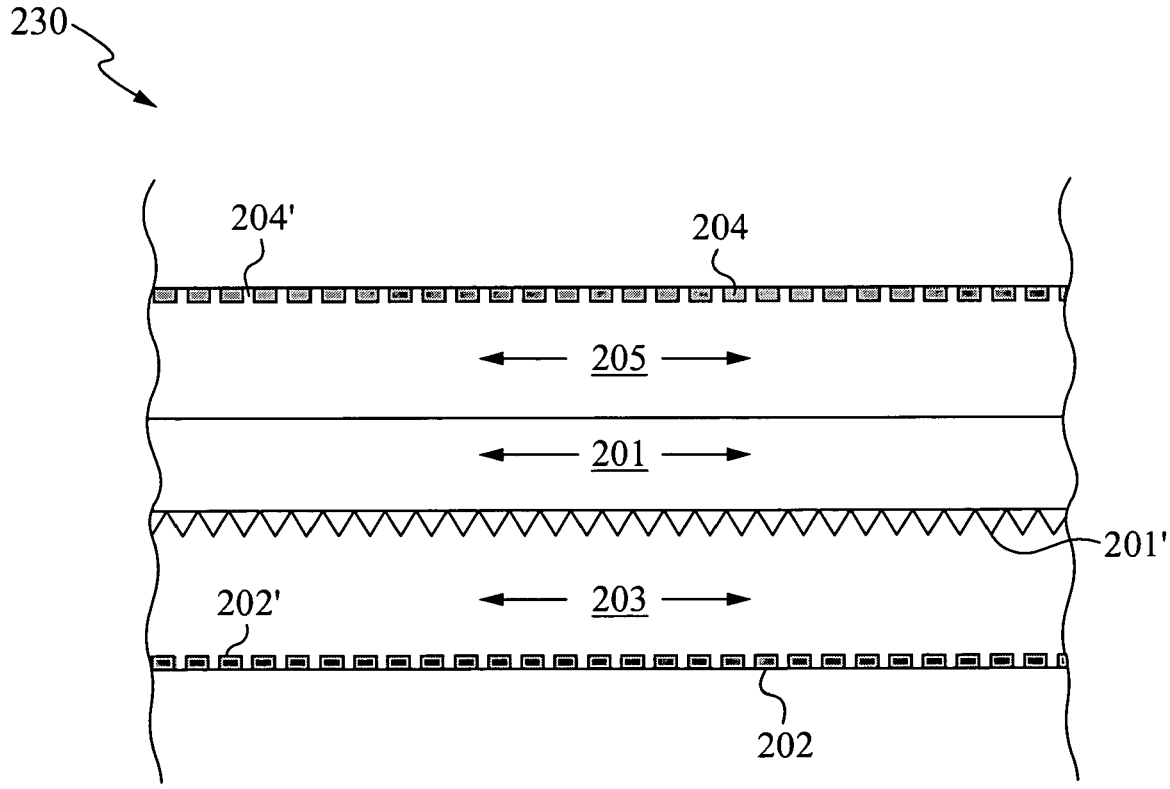

FIG. 2D illustrates a detailed cross-sectional schematic of an alternative embodiment of the double diffusion structure 200 shown in FIG. 2A. Specifically, the double diffusion structure 230 shown in FIG. 2D comprises a diffusion layer 201, a plurality of micro-lenses 201', a first grill 202 with a reflective surface 202', and a second grill 204 with a reflective surface 204'. An area between the plurality of micro-lenses 201' (of the diffusion layer 201) and the reflective surface 202' (of the first grill 202) forms a first diffusion cavity 203. In addition, an area between the diffusion layer 201 and the reflective surface 204' (of the second grill 204) forms a second diffusion cavity 205.

Figure 3A:
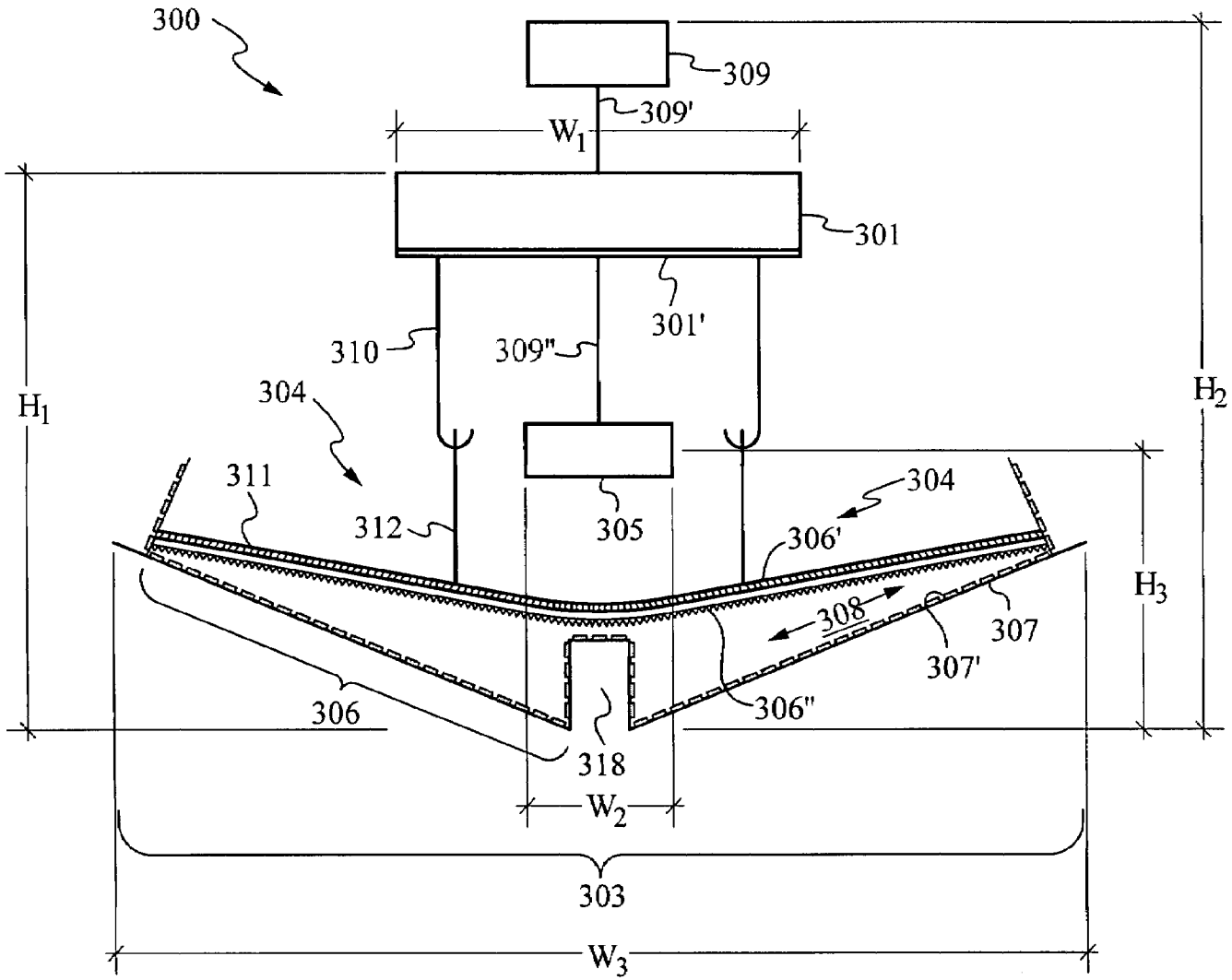
FIG. 3A illustrates a simplified drawing of a device for indirect lighting, in accordance with the instant invention.

FIG. 3A illustrates a simplified drawing of a device 300 for indirect lighting, in accordance with the instant invention. The device 300 is preferably configured to output light at an efficiency of at least 70%. Further, the device 300 is configured to provide better than an 8:1 ceiling lighting contrast between rows of devices with a 16 feet spacing. The device 300 comprises a reflective plate 301, a cover 303, and a means for providing a light source 305. The means for providing a light source 305 and/or the reflective plate 301 may be coupled via a cable 309", wherein the cable preferably has a load rating of 250 pounds or greater.

The reflective plate 301 and the cover 303 define a free-cavity 304 configured to output light. In alternative embodiments of the current invention, the free-cavity 304 is enclosed. The reflective plate 301 is preferably flat but may also be convex, concave, or angular in alternative embodiments. Further, the reflective plate 301 preferably comprises a reflective paint 301' with 95% or greater reflectivity for flourescent lighting. The means for providing a light source 305 is positioned in the free-cavity 304. The means for providing a light source 305 preferably comprises flourescent light bulbs.

The cover 303 comprises a double diffusion structure 306 and a channel feature 318. The cover 303 preferably further comprises a plurality of precision perforations, but may also be enclosed. The plurality of precision perforations may comprise precision machine punched and spray powder coated holes. The double diffusion structure 306 comprises a diffusion layer 306' with a plurality of micro-lenses 306" and a grill 307 with a reflective surface 307'. The reflective surface 307' of the grill 307 preferably comprises a reflective paint with 95% or greater reflectivity for flourescent lighting (not shown). In alternative embodiments, the reflective surface 307' of the grill 307 may also comprise a highly polished metal, or a mirror. The diffusion layer 306' and the grill 307 with the reflective surface 307' define a diffusion cavity 308 and together these form the double diffusion structure 306 similar to the one described in FIG. 2A, above. In alternative embodiments, the double diffusion structure 306 further comprises a second grill 311 with a reflective surface (not shown) positioned between the diffusion layer 306' and the reflective surface 307', as shown in FIG. 2D. The plurality of micro-lenses 306" preferably have protrusions that face inwards, toward the diffusion cavity 308.

The device 300 further comprises a mounting structure 309 preferably configured to couple the device 300 in a suspended configuration to a ceiling (not shown). In alternative embodiments of the current invention, the mounting structure 309 is configured to couple the device 300 in a flushed configuration between joists, ceiling grids, or 2"×4" grids (not shown). In yet other alternative embodiments, the mounting structure 309 is configured to couple the device 300 to a wall or to secure the device 300 to a ceiling grid via a clip (not shown).

The device 300 also comprises a latch 310 and a channel feature 318, wherein the latch 310 is preferably coupled (not shown) to the mounting structure 309 and the cover 303, preferably via spring loaded latches (not shown). Alternatively, the latch 310 is coupled to the reflective plate 301 and the cover 303 via a cable 312. The cable 312 can be hooked to secure or release the cover 303. Further, the mounting structure 309 and the reflective plate 305 may be coupled via a cable 309', wherein the cable preferably has a load rating of 250 pounds or greater.

The width $W_1$ of the reflective plate 301 is preferably in the range of 2" to 10". The width $W_2$ of the means for providing a light source 305 is preferably in the range of 1" to 3.5". The width $W_3$ of the cover 303 is preferably in the range of 6" to 24". The height $H_1$ from the bottom of the cover 303 to the center of the means for providing a light source 305 is preferably in the range of 1.5" to 4.5". The height $H_2$ from the bottom of the cover 303 to the top of the mounting structure 309 is preferably in the range of 3" to 6". The height $H_3$ from the bottom of the cover 303 to the center of the means for providing a light source 305 is preferably in the range of 1" to 3.5".

In further embodiments of the current invention, a device for providing indirect lighting from a free-cavity (not shown) is disclosed. The alternate embodiment comprises a means for generating light in the free-cavity and a means for diffusing light from the free-cavity coupled to the means for generating light. The means for diffusing light comprises a diffusion cavity that is configured to partially diffuse light in a downward direction and partially reflect light in an upward direction.

The current invention also discloses a system for providing indirect lighting. The system comprises a plurality of fixtures configured to output indirect lighting (not shown) at an efficiency of at least 70% or to provide better than 8:1 ceiling lighting contrast. The plurality of fixtures comprise a plurality of reflective plates and a plurality of covers. Each cover comprises a double diffusion structure. The plurality of reflective plates and the plurality of covers define a plurality of free cavities configured to output light. The system also comprises a means for controlling the configured indirect lighting that is coupled to the fixtures. Further, the system comprises a means for providing power that is coupled to the fixtures and the means for controlling the configured indirect lighting. In the preferred system, the double diffusion structures comprise grills each with a reflective surface and diffusion layers. The diffusion layers preferably comprise a plurality of micro-lenses, but in alternative embodiments, may not comprise a plurality of micro-lenses. The grills with reflective surfaces and the diffusion layers form the double diffusion cavities.

In addition, the current invention also discloses a method of making indirect lighting fixtures. The preferred method comprises forming a cover, forming a free-cavity configured to output indirect lighting, and providing a light source in the free-cavity. The cover comprises a double diffusion structure configured to partially diffuse and partially reflect light. The free-cavity is formed by an area between a reflective plate and the cover. The light source is interposed between the reflective plate and the cover. The double diffusion structure preferably comprises a grill with a reflective surface and at least one diffusion layer with a plurality of micro-lenses. The grill and at least one diffusion layer form a diffusion cavity.

Figure 3B:
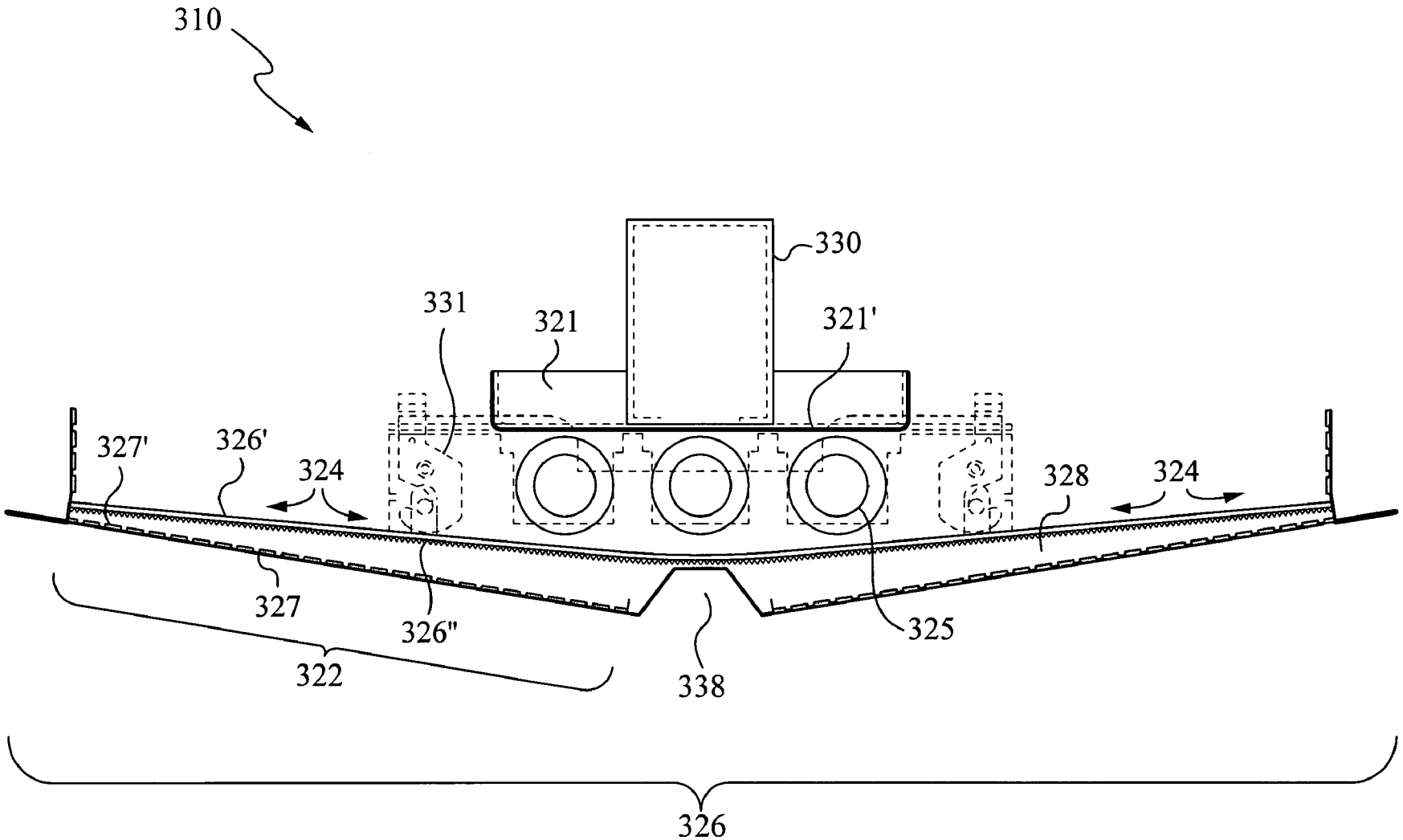
FIG. 3B illustrates a more detailed cross-sectional schematic of a indirect lighting fixture, in accordance with the instant invention.
Figure 3C:
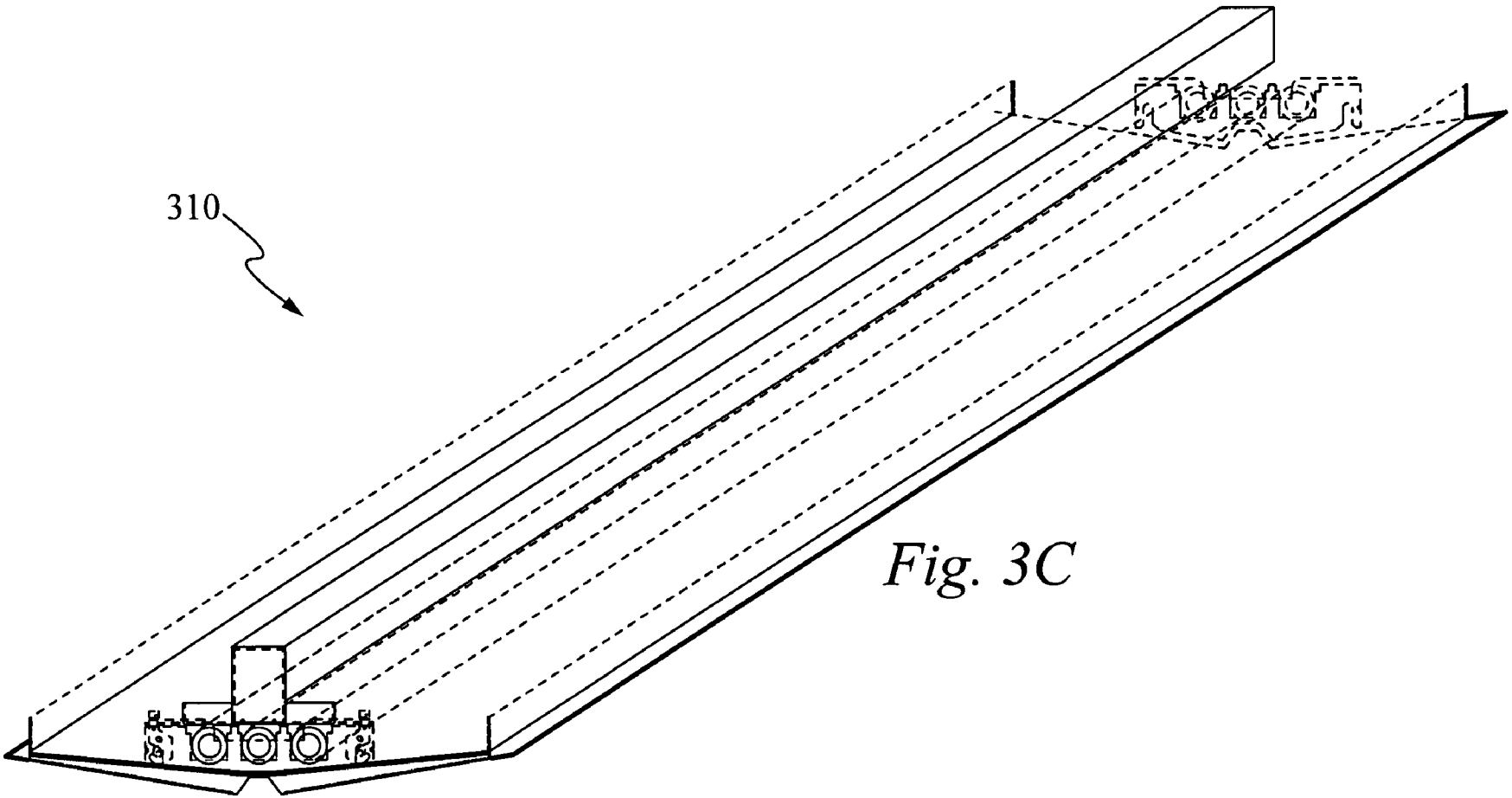
FIG. 3C illustrates a perspective drawing of the indirect lighting fixture shown in FIG. 3B, in accordance with the instant invention.

FIG. 3B illustrates a detailed cross-sectional schematic of a indirect lighting fixture, while FIG. 3C illustrates a perspective drawing of the indirect lighting fixture shown in FIG. 3B, in accordance with the instant invention. Specifically, FIG. 3B shows a fixture for providing indirect lighting from a free-cavity 310. The fixture 310 comprises a light source 325 in a free-cavity 324, and a cover 326. The cover 326 comprises a diffusion structure 322 and a channel feature 338. Preferably, the diffusion structure 322 comprises a first diffusion layer 326' with a plurality of micro-lenses 326" and a grill 327 with a reflective surface 327'. An area between the first diffusion layer 326' and the reflective surface 327' forms a diffusion cavity 328.

In alternative embodiments, the diffusion structure 322 may be in a double diffusion configuration (not shown) that would comprise a first diffusion layer and a second diffusion layer. The first diffusion layer would comprise a first grill with a reflective surface and a first plurality of micro-lenses. The second diffusion layer would comprise a second grill with a reflective surface and a second plurality of micro-lenses. The first and second diffusion layers would define a diffusion cavity configured to partially diffuse light in a downward direction and partially reflect light in an upward direction in a manner similar to that of the diffusion structures shown in FIGS. 2B-2D.

The fixture further comprises a reflective plate 321 and a mounting structure 330 that is coupled to the reflective plate 321. An area between the reflective plate 321 and the cover 326 forms the free-cavity 324. The reflective plate 321 and the cover 326 are coupled via a latch 331 with a spring (not shown). As discussed above, in alternative embodiments, the cover 326 could further comprise a second grill (not shown) with a reflective surface similar to the diffusion cavities shown in FIGS. 2B-2D. The second grill (not shown) in the alternate embodiment is positioned between the first diffusion layer and the grill.

The plurality of micro-lenses 326" preferably have protrusions that face inwards towards the diffusion cavity 328 and are preferably positioned to partially diffuse light into the diffusion cavity 328. The reflective plate 321 preferably comprises a reflective paint 321'. The reflective paint 321' preferably has a 95% or greater reflectivity for flourescent lighting. Further, the light source 325 preferably comprises flourescent light bulbs and is positioned within the free-cavity 324.

FIG. 3C shows the fixture for providing indirect lighting from a light source in a free-cavity in perspective view. Specifically, a fixture for indirect lighting 310 is shown in an elongated configuration.

Figure 4A:
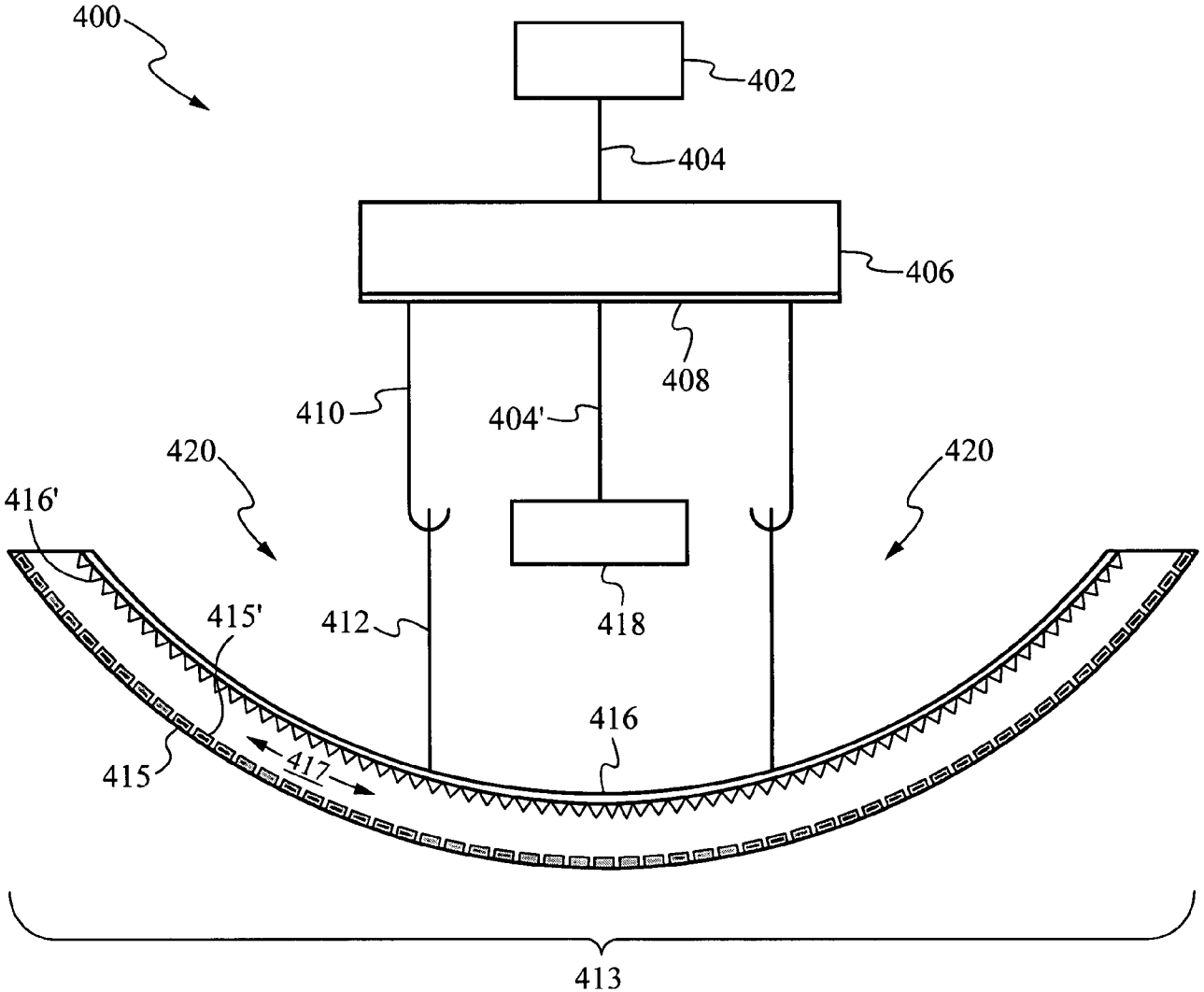
FIG. 4A illustrates a simplified drawing of a circular indirect lighting device, in accordance with the instant invention.
Figure 4B:
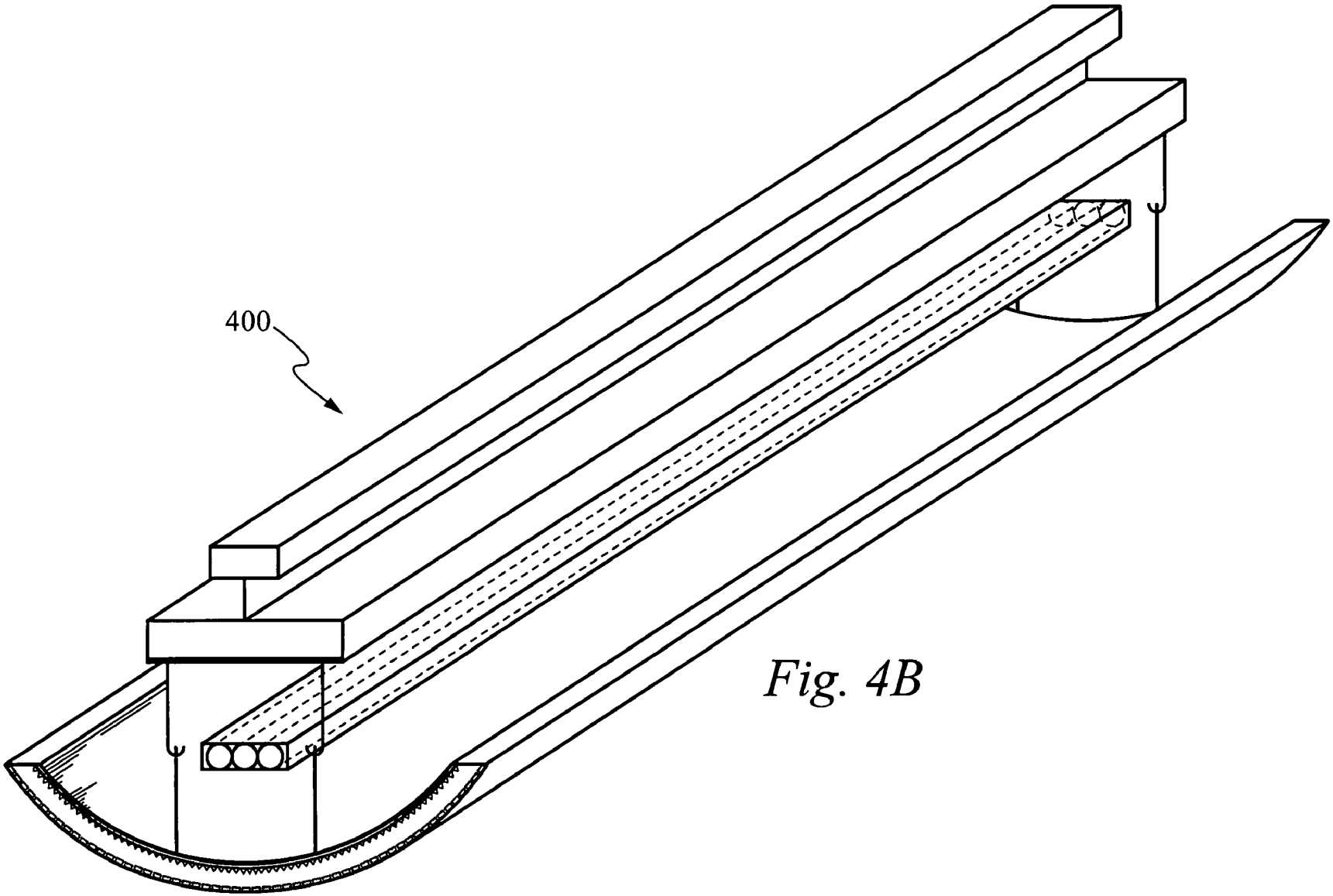
FIG. 4B illustrates a perspective drawing of a circular indirect lighting device, in accordance with the instant invention.

FIG. 4A illustrates a simplified drawing of a circular indirect lighting device 400 while FIG. 4B illustrates a perspective drawing of the circular indirect lighting device shown in FIG. 4A, in accordance with the instant invention.

Specifically, FIG. 4A shows a circular device 400 for indirect lighting comprising a reflective plate 406 and a cover 413. The cover 413 comprises a grill 415 with a reflective surface 415', a diffusion layer 416 with a plurality of micro-lenses 416'. An area between the diffusion layer 416 and the grill 415 with the reflective surface 415' defines a diffusion cavity 417.

The reflective plate 406 and the cover 413 define a free-cavity 420 configured to output light at an efficiency of at least 70%, or alternatively, to provide better than 8:1 ceiling lighting contrast between the rows of fixtures with rows on 16 feet spacing. The device 400 further comprises a means for providing indirect lighting from a light source 418 in the free-cavity 420. The means for providing indirect lighting from a light source 418 and the reflective plate 408 is coupled via a cable 404' preferably having a load rating of 250 pounds or greater. The means for providing indirect lighting from a light source 418 is positioned between the reflective plate 406 and the cover 413. The cover 413 is preferably perforated, but may also be enclosed.

The reflective plate 406 is preferably flat. However, in alternative embodiments, the reflective plate 406 has a convex, concave, or angular shape. In the preferred embodiment, the reflective plate 406 further comprises reflective paint 408, wherein the reflective paint 408 reflects flourescent lighting with 95% or greater reflectivity. In other embodiments, the reflective plate 406 comprises a highly polished metal or a mirror.

In the preferred embodiment of the current invention, the device 400 further comprises a mounting structure 402 coupled to the reflective plate 406. In the preferred embodiment, the mounting structure 402 is configured to couple the device 400 in a suspended configuration (not shown). In alternative embodiments of the current invention, the mounting structure 402 is configured to couple the device 400 in a flushed configuration (not shown). In yet other alternative embodiments, the mounting structure 402 is configured to couple the device 400 to a ceiling or to a wall. The mounting structure 402 and the reflective plate 406 may be coupled via a cable 404 preferably having a load rating of 250 pounds or greater. Further, the device may be coupled in a suspended configuration via a cable (not shown). In yet another embodiment, the mounting structure 402 is configured to secure the device 400 to a ceiling grid via a clip (not shown).

In the preferred embodiment of the current invention, the device 400 further comprises a latch 410, wherein the latch 410 is coupled to the reflective plate 406 and the cover 413. The latch 410 may further comprise a hook and a spring (not shown). The latch 410 is coupled to the reflective plate 408 and the cover 413, preferably via a cable 412. Further, in the preferred embodiment, the means for providing indirect lighting 418 comprises flourescent light bulbs.

The diffusion layer 416 is preferably configured to partially diffuse light in a downward direction and partially reflect light in an upward direction. In alternative embodiments, the diffusion layer 416 further comprises a plurality of precision perforations (not shown) configured for clear light distribution in a downward direction. The plurality of precision perforations comprise precision machine punched and spray powder coated holes.

FIG. 4B shows the circular indirect lighting device 400 in a perspective view in accordance with the instant invention. Specifically, a device 400 is shown in an elongated configuration.

Figure 5:
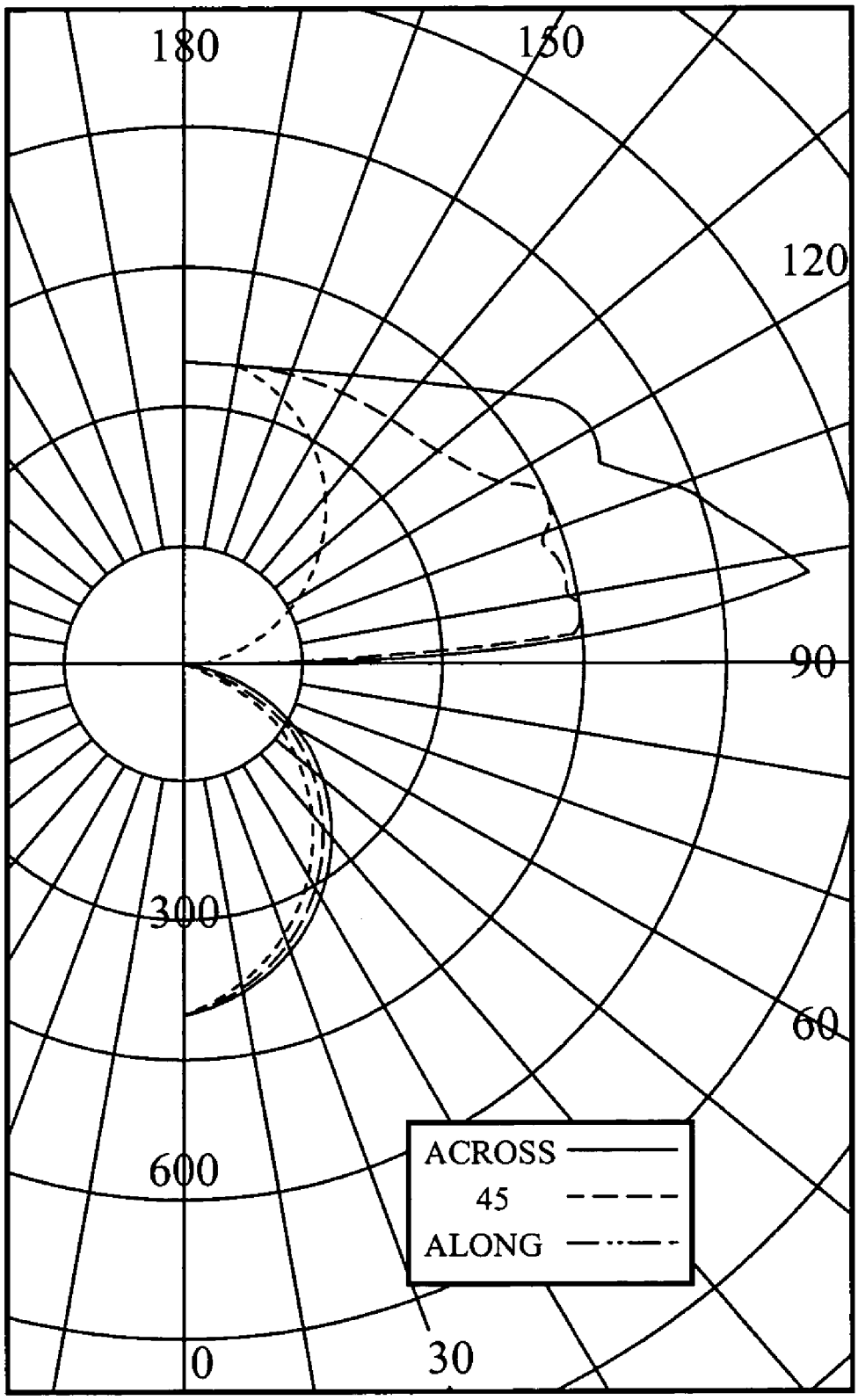
FIG. 5 illustrates a light distribution graph of the configured indirect lighting provided by the indirect lighting device, in accordance with the instant invention.

FIG. 5 illustrates a light distribution graph of the configured indirect lighting provided by the indirect lighting device, in accordance with the instant invention. Specifically, the light distribution for a 4 foot direct/indirect suspended lighting device is shown. The test results are for a lighting device having a lighting source with a 4500 lms lumen rating (54 watt T5 lamp) and a ballast operating at 120 VAC/62 watt. In the 0-90 zone, the lighting device exhibited 934 lumens with approximately 29% of the light going downward (i.e. direct lighting) while in the 90-180 zone, the device exhibited 2283 lumens with approximately 71% of the light going upward (i.e. indirect lighting). The efficiency percentage was at 71.5% with a 0.93 paint reflectance. Note that the shape of the light distribution graph can be any shape but a graph corresponding to a 70% light distribution efficiency is preferably the minimum.

There have been attempts to make highly efficient indirect lighting fixtures using reflective and/or optical baffles within the optical cavities of the fixtures. Lighting fixtures using reflective and/or optical baffles have a number of shortcomings. Reflective and/or optical baffles can be misaligned while servicing the lighting fixtures or while installing the lighting fixtures, resulting in lighting output inefficiencies. The reflective and/or optical baffles are generally obstructive and make changing light bulbs or flourescent lighting tubes difficult. Further, such devices can be expensive to fabricate.

In contrast to lighting fixtures with reflective and/or optical baffles, lighting fixtures in accordance with the embodiments of the invention provide highly efficient and effective distribution of indirect lighting using a free-cavity configuration. The lighting fixtures of the current invention can have the additional benefits of lower fabrication and shipping costs and have easier installation and maintenance requirements.

The present invention has been described in terms of specific embodiments incorporating details to facilitate the understanding of the principles of construction and operation of the invention. Such references herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A device for indirect lighting comprising:

a. an elongated reflective plate;

b. an elongated cover comprising a double diffusion structure, wherein the double diffusion structure is positioned below the reflective plate and separated from the reflective plate by a distance, wherein the elongated reflective plate and the elongated cover define a free-cavity configured to output light generated from a light source within the free-cavity and between the elongated reflective plate and the elongated cover the doubled diffusion layer that includes a diffusion layer with micro-lenses and a reflective grill with a reflective surface facing inward towards the free-cavity and towards the diffusion layer.

2. The device of claim 1, wherein the double diffusion structure further comprises a second grill with a reflective surface.

3. The device of claim 1, wherein the plurality of micro-lenses face inwards towards the diffusion cavity.

4. The device of claim 1, wherein the device is configured to output light at an efficiency of at least 70%.

5. The device of claim 1, further comprising a mounting structure configured to couple the device to a ceiling.

6. The device of claim 1, further comprising a mounting structure configured to couple the device in a flushed configuration or in a suspended configuration.

7. The device of claim 1, further comprising a latch, wherein the latch is coupled to the reflective plate and the cover.

8. The device of claim 7, wherein the latch further comprises a hook and a spring.

9. The device of claim 1, wherein the free-cavity is enclosed.

10. The device of claim 1, wherein the elongated reflective plate is flat.

11. The device of claim 1, wherein the elongated cover further comprises a channel feature.

12. The device of claim 1, wherein the elongate reflective plate comprises a reflective paint with 95% or greater reflectivity for flourescent lighting.

13. The device of claim 1, wherein the reflective grill comprises a polished metal.

14. The device of claim 1, wherein the reflective grill comprises a mirror.

15. The device of claim 1, wherein the reflective grill comprises a reflective paint with 95% or greater reflectivity for flourescent lighting.

16. A fixture for providing indirect lighting from an elongated free-cavity, the fixture comprising:

a. a fluorescent light source; and b. an elongated cover, wherein the elongated cover comprises a first grill with a reflective surface facing inward towards the elongated free-cavity and a diffusion layer positioned between the first grill and the elongated free-cavity, wherein an area between the reflective surface and the diffusion layer forms an elongated diffusion cavity for emitting light reflected within the elongated diffusion cavity; and c. an elongated reflective plate positioned directly above the elongated cover, wherein an area between the elongated reflective plate and the elongated cover forms the elongated free-cavity with open sides for emitting light reflected within the free-cavity from the fluorescent light source with the fluorescent light source positioned within the free-cavity and between the elongated cover and the elongated reflective plate.

17. The fixture in claim 16, wherein the diffusion layer further comprises a plurality of micro-lenses.

18. The fixture in claim 16, wherein the elongated cover further comprises a second grill with a reflective surface.

19. The fixture in claim 17, wherein the plurality of micro-lenses face inwards towards the elongated diffusion cavity.

20. The fixture in claim 17, wherein the plurality of micro-lenses are positioned to partially diffuse light into the elongated diffusion cavity.

21. The fixture in claim 16, wherein the reflective plate comprises a reflective paint with 95% or greater reflectivity for flourescent lighting.

22. The fixture in claim 16, further comprising a mounting structure suspending the elongated cover 6 inches or less from a ceiling.

23. A method of making indirect lighting fixtures comprising:

a. forming an elongated cover, wherein the cover comprises a double diffusion structure configured to partially diffuse and partially reflect light;

b. forming an elongated free-cavity configured to output indirect lighting, wherein the elongated free-cavity is defined by a space between an elongated reflective plate and the elongated cover; and c. providing a light source with fluorescent tubes within the elongated free-cavity, wherein the light source is interposed between the elongated reflective plate and the elongated cover, wherein the double diffusion structure includes a grill with a reflective surface that faces inward toward elongated free-cavity and a diffusion layer with a plurality of micro-lenses positioned between the reflective surface of the grill and the elongated free-cavity, wherein the grill and the diffusion layer form a diffusion cavity.

24. The method in claim 23, wherein the free-cavity is configured to output light at an efficiency of at least 70%.

25. A device for indirect lighting in an elongated configuration comprising:

a. a mounting structure;

b. a reflective plate coupled to the mounting structure;

c. a cover coupled to the reflective plate, wherein the cover comprises a double diffusion structure, wherein the reflective plate and the cover define a free-cavity configured to output light and wherein the double diffusion structure includes a first grill with a reflective surface facing inward towards the free-cavity and a diffusion layer with plurality of micro-lenses and positioned between the reflective surface of the first grill and the free-cavity; and d. a flourescent light source positioned within the free-cavity and between the reflective plate and the cover.

26. The device of claim 25, wherein the double diffusion structure further comprises a second diffusion layer, wherein the second diffusion layer comprises a second grill with a reflective surface.

27. The device of claim 25, wherein the device is configured to output light at an efficiency of at least 70%.

28. A device for indirect lighting, the device comprising:

a) an elongated reflective plate;

b) an elongated cover wherein the elongated cover and the elongated reflective plate define and elongated free-cavity with open sides and wherein the cover comprises a doubled diffusion layer that includes a diffusion layer with micro-lenses and a reflective grill with a reflective surface facing inward towards the elongated free cavity and facing towards the diffusion layer; and c) means for providing a light source, the means for providing a light source being configured to hold one or more elongated flourescent light bulbs within the elongated free-cavity and directly between the elongated reflective plate and the elongated cover.

* * * * *

UNITED STATES PATENT AND TRADEMARK OFFICE

CERTIFICATE OF CORRECTION

PATENT NO. : 7,284,883 B2
APPLICATION NO. : 11/378584
DATED : October 23, 2007
INVENTOR(S) : Walter Blue Clark and David Daoud Aziz It is certified that error appears in the above-identified patent and that said Letters Patent is hereby corrected as shown below:

On the Title Page, in the References Cited

Under OTHER PUBLICATIONS, please replace the reference

ITL Boulder Test Report, May 12, 2002.

with the reference

ITL Boulder Test Report, May 14, 2002.

Signed and Sealed this

Fourth Day of March, 2008

JON W. DUDAS
*Director of the United States Patent and Trademark Office*